US005562085A

United States Patent [19]

Kosuda et al.

[11] Patent Number: 5,562,085

[45] Date of Patent: Oct. 8, 1996

[54] DEVICE FOR CONTROLLING NUMBER OF OPERATING CYLINDERS OF AN INTERNAL COMBUSTION ENGINE

[75] Inventors: Toru Kosuda, Okazaki; Osamu Sato, Obu, both of Japan

[73] Assignee: Nippondenso Co., Ltd., Kariya, Japan

[21] Appl. No.: 458,766

[22] Filed: Jun. 2, 1995

[30] Foreign Application Priority Data

Jun. 10, 1994 [JP] Japan ..... 6-128925

[51] Int. Cl.[6] ..... F02M 25/07

[52] U.S. Cl. ..... 123/568; 123/571; 123/198 F

[58] Field of Search ..... 123/198 F, 481, 123/568, 569, 571

[56] References Cited

U.S. PATENT DOCUMENTS

| | | | |
|---|---|---|---|
| 4,198,940 | 4/1980 | Ishida | 123/568 |
| 4,224,912 | 9/1980 | Tanaka | 123/568 |
| 4,233,946 | 11/1980 | Yorioka et al. | 123/568 |
| 4,257,371 | 1/1981 | Ishida | 123/198 F |
| 4,292,938 | 10/1981 | Tanaka et al. | 123/568 |
| 4,304,208 | 12/1981 | Etoh et al. | 123/568 |
| 4,313,406 | 2/1982 | Iizuka et al. | 123/568 |
| 4,359,024 | 11/1982 | Lootens et al. | 123/198 F |
| 4,411,228 | 10/1983 | Sugasawa | 123/568 |
| 4,556,026 | 12/1985 | Masuda et al. | 123/198 F |
| 4,561,408 | 12/1985 | Jenkins | 123/571 |

FOREIGN PATENT DOCUMENTS

| | | |
|---|---|---|
| 60-52360 | 4/1985 | Japan . |
| 61-118518 | 6/1986 | Japan . |

*Primary Examiner*—Willis R. Wolfe
*Attorney, Agent, or Firm*—Cushman, Darby & Cushman

[57] ABSTRACT

A device for controlling a partial number of engine cylinders employs a geneva movement, intake-air-cutoff valves, an exhaust-gas-cutoff valve and a DC motor. The geneva movement divides the driving force of the DC motor into two: a force intermittently driving the intake-air-cutoff valves and a force driving the exhaust-gas-cutoff valve, so that the exhaust-gas-cutoff valve cannot open until the intake-air-cutoff valve has closed when the engine operation is changed over to a partial-cylinder-operation mode, and the intake-air-cutoff valve cannot open until the exhaust-gas-cutoff valve has closed when the engine operation is changed over to the full-cylinder-operation mode. As a result, time required for changeover of the engine operation between the full-cylinder operation and the partial-cylinder operation is minnimized and additional driving unit is omitted.

15 Claims, 7 Drawing Sheets

| α | GENEVA MOVEMENT | I.A.C. VALVE | E.G.C. VALVE |
|---|---|---|---|
| 0° |   |   |   |

DEVICE FOR CONTROLLING NUMBER OF OPERATING CYLINDERS OF AN INTERNAL COMBUSTION ENGINE

CROSS REFERENCE TO RELATED APPLICATION

The present application is based on and claims priority from Japanese Patent Application No. Hei 6-128925 filed on Jun. 10, 1994, the contents of which are incorporated herein by reference.

BACKGROUND OF THE INVENTION

1. Field of the Invention

The present invention relates to a device for controlling number of operating cylinders of an internal combustion engine for a vehicle.

2. Description of the Related Art

There has been proposed a device which controls the number of operating cylinders of an internal combustion engine (hereinafter referred to as an engine) in response to the engine operating condition in order to reduce the fuel consumption of the vehicle engine.

For example, Japanese Patent Apllication Laid-open No. Sho 61-118581 discoloses a device which is equipped with a slider and a pin. The pin engages with or disengages from the slider in a lifter bodies of intake and exhaust valves. When an engine cylinder is put into operation, the pin is driven by an oil pressureunit to engage with the slider by an oil pressure to operate the intake and the exhaust valves. On the other hand when the pin is disengaged from the slider, the valves are put out of However, if the above structure is installed in an engine, it is necessary to change the engine structure from the ordinary engine structure to a considerable extent. Especially, the engine having multiple intake and exhaust valves for each cylinder requires a substantial alteration.

In addition, when valves of a controlled cylinder stop its operation while other cylinders of the engine are running, the lubricating oil of the suspended cylinder is sucked out since the pressure in the controlled or suspended cylinder becomes negative, thereby causing insufficient lubrication of the cylinder.

In order to provide the above function without considerable change of the driving mechanism, there has been proposed another control device which utilizes exhaust gas to control operation of the cylinders.

Such device is disclosed in Japanese Utility Model Application Laid-open No. 60-52360. The device is equipped with an intake-air-cutoff valve which is driven by a motor to open or close the air-intake passage, an exhaust-gas-intake passage which returns the exhaust gas from the exhaust-side of the suspended cylinder to a downstream portion of the intake-air-cutoff valve and an exhaust-gas-cutoff valve which is driven by a driving unit to open or close the exhaust-gas-intake passage. A driving unit is provided in addition to a motor for driving the intake-air-cutoff valve. When the intake-air-cutoff valve opens and the exhaust-gas-cutoff valve closes, all cylinders of the engine operate. On the other hand, when the intake-air-cutoff valve closes and the exhaust-gas-cutoff valve opens, a set number of cylinders are suspended and the exhaust gases (or air) return through the exhaust-gas-intake passage to the suspended cylinders.

Although the exhaust gas (or air) circulating type device described above does not require a considerable change from the ordinary engine structure, it requires two driving units and additional cost for providing the units.

In addition, the intake-air-cutoff valve must be closed before the exhaust-gas-cutoff valve is opened since the pressure in the controlled or suspended cylinder becomes negative, in order to have the exhaust gas circulation in the suspended cylinder, while the exhaust-gas-cutoff valve must be closed before the intake-air cutoff valve is opened in order to restore the suspended cylinder to operation. Thus, an electronic valve control unit is necessary to control the sequence of the above mentioned valve operation, and, therefore, sensors for sensing the opening or closing of the valves are also necessary.

In other words, an engine can only change over from the full-cylinder operation to the partial-cylinder operation after the intake-air-cutoff valve has been closed by the motor and subsequently the exhaust-gas-cutoff valve is opened by a different driving unit after the intake-air-cutoff is detected by the sensor, and the engine can only return to the full-cylinder operation after the exhaust-gas-cutoff valve has been closed by the different driving unit and the intake-air cutoff valve is subsequently opened by the motor after the exhaust-gas-cutoff state is detected by the sensor.

Since it takes relatively long time for the cutoff valves and the driving units to operate after receiving control signals from the sensor, a comparatively long time period is necessary to change over the engine operation between the full-cylinder-engine operation and the partial-cylinder-engine operation.

As a result, torque shocks, slow response or stagnation of the engine operation may be caused when the changeover of the engine operation between the full-cylinder operation and the partial cylinder operation is initiated.

SUMMARY OF THE INVENTION

The present invention is made in view of the foregoing problems, and has a primary object of providing an improved device for controlling number of operating cylinders of an engine having a simple and low cost structure.

Another object of the present invention is to provide a highly responsive device for controlling number of operating cylinders of an engine which includes intake-air-cutoff valves, an exhaust-gas-cutoff valve, a geneva movement and a single driving unit for driving the valves, so that time required for the engine-operation-changeover between the full-cylinder operation and the partial-cylinder operation is significantly reduced.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENT

Figure 1:
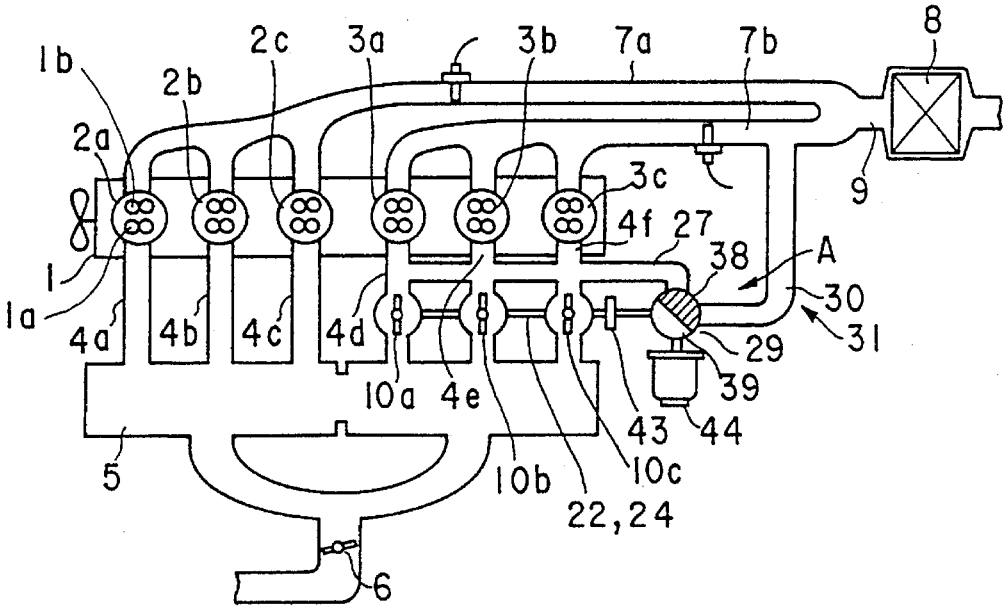
FIG. 1 is a schematic plan view illustrating an engine in a full-cylinder (six-cylinder) operation with a device for controlling number of operating cylinders according to a first embodiment of the present invention.

Preferred embodiments according to the present invention will now be described with reference to the appended drawings.

A first embodiment of the present invention is described with reference to FIG. 1 through FIG. 8.

An engine 1 has three full-time operating cylinders 2*a*, 2*b* and 2*c* disposed at the left side thereof and cylinders 3*a*, 3*b* and 3*c* disposed at the right side which are suspended when the engine operates under a partial load condition. Each cylinder has an air-intake valve 1*a* driven by a cam (not shown) and an exhaust valve 1*b* driven by another cam (not shown) and is supplied with fuel in a well-known manner.

A plurality of air-intake pipes 4*a*, 4*b*, 4*c*, 4*d*, 4*e* and 4*f* (which form a air-intake passage of the engine 1) are disposed at one side of the engine 1 and connect each of the cylinders (2*a* through 3*f*) to an air-intake manifold 5. Air or air-fuel mixture is introduced to the cylinders through a throttle valve 6 disposed at an upstream portion of the air-intake manifold 5. Exhaust manifolds 7*a* and 7*b* are disposed at the other side of the engine 1 and connect the left side cylinders 2*a*, 2*b* and 2*c* and the right side cylinders 3*a*, 3*b* and 3*c* to an exhaust pipe 9. The exhaust pipe 9 is equipped with a catalytic converter 8 to purify the exhaust gases discharged from the cylinders. Each of the air-intake pipes 4*d*, 4*e* and 4*f* connects each of the right side cylinders 3*a*, 3*b* and 3*c* with the air intake manifold 5 and is equipped with each of intake-air-cutoff valves 10*a*, 10*b* and 10*c*, which compose the main part of a device 'A' for controlling number of operating cylinders (hereinafter referred to as the cylinder control device). Structure of the intake-air-cutoff valves 10*a*, 10*b* and 10*c* is illustrated in FIGS. 3 through 6.

Figure 3:
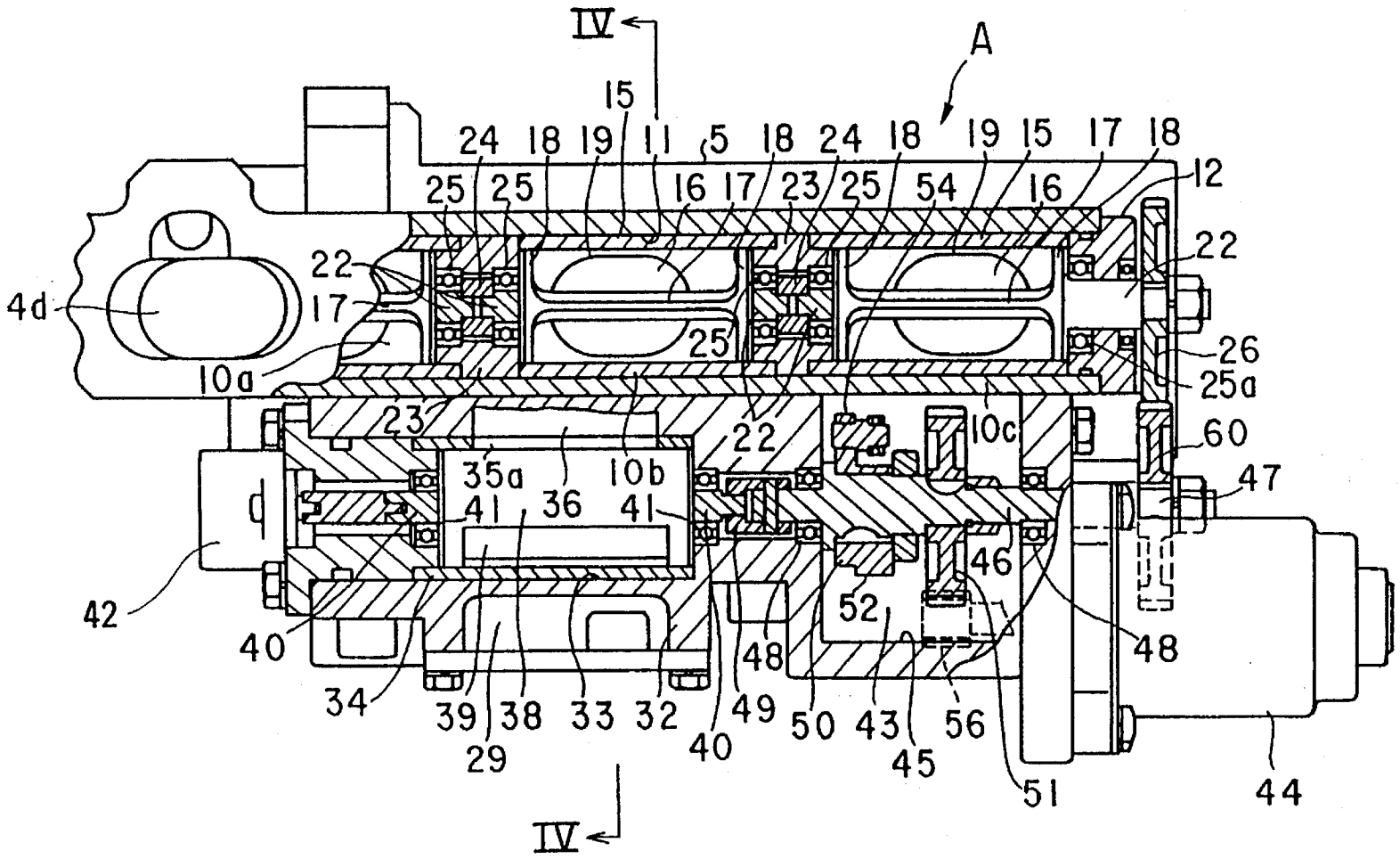
FIG. 3 is a cross-sectional side view of a main portion of the device including a air-intake pipe, an intake-air-cutoff valve, an exhaust-gas cutoff valve, a geneva movement and a DC motor.

In FIG. 3, the cylinder control device 'A' has an air passage block in which a straight cylindrical space 11 is formed to intersect the air-intake pipes 4*d*, 4*e* and 4*f* and accommodate the intake-air-cutoff valves 10*a*, 10*b* and 10*c* and covers 12 disposed at the both ends thereof.

Figure 4:
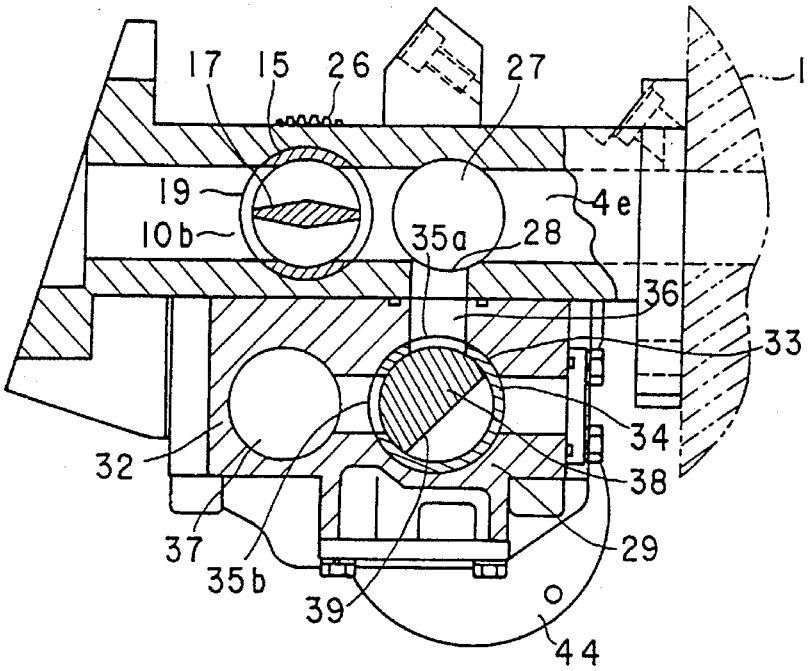
FIG. 4 is a cross-sectional view taken along a line IV—IV of FIG. 3 illustrating the intake-air-cutoff valve and the exhaust-gas-cutoff valve in the full-cylinder operation.
Figure 5:
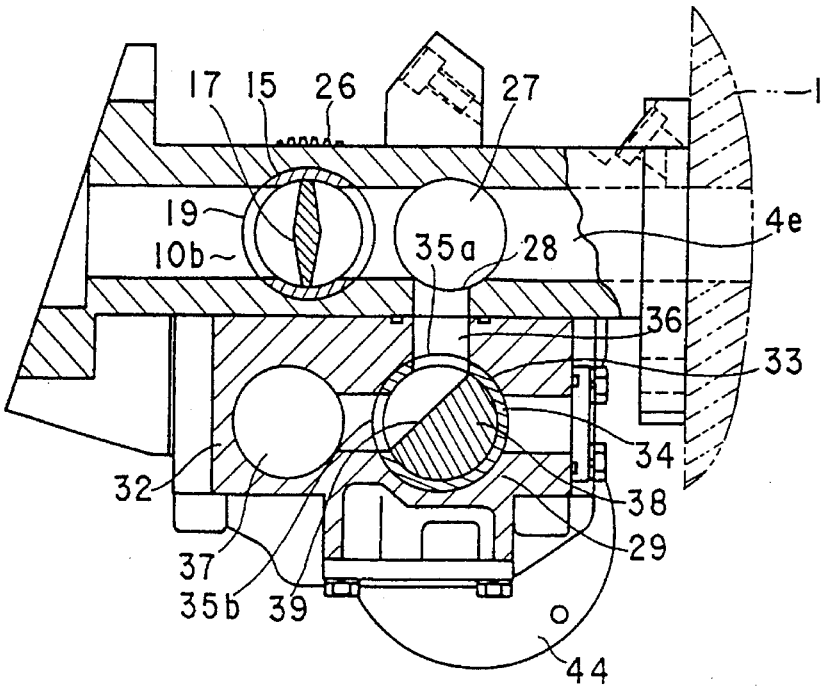
FIG. 5 is a cross-sectional view of the same portion in the partial-cylinder operation as in FIG. 4.

Cylindrical bushings 15 are inserted into the space 11 so that each meets each of the air-intake pipes 4*d*, 4*e* and 4*f*. Each of the bushings 15 has a pair of through holes 19 open to both sides of each of the air-intake pipes 4*d*, 4*e* and 4*f* as shown in FIGS. 4 and 5.

Valve bodies 16 are rotatably inserted into each of the cylindrical bushings 15. Each of the valve bodies 16 has a pair of disk-plates 18 which slide on the inner surface of corresponding one of the bushings 15 and a valve member 17 which connects the pair of the disk plates 18. The valves 10*a*, 10*b* and 10*c* open when the valve members 17 are placed in parallel with the axes of the air-intake pipes 4*d*, 4*e* and 4*f* (FIG. 4), and close when the valve members 17 are placed perpendicular to these axes (FIG. 5) so that the intake air flowing trough the intake pipes 4*d*, 4*e* and 4*f* may be introduced and cut off.

The valve bodies 16 are interlinked one another. Each of the disk plates 18 has a shaft 22 which extends from the center of the outer surface. cylindrical spacers 23 are disposed between the valves 16 so as to fill up the cylindrical space 11. Joints 24 are disposed inside the spacer 23 and connect the shafts 22 which extend from the disk plates 18 located at the opposite sides. Pairs of bearings 25 are secured to the both ends of the spacers 23 to rotatably carry the shafts 22, so that all the valve members 17 rotate together.

The leftmost and the right-most shafts 22 which are the end portions of the intake-air-cutoff-valve-train are rotatably supported by bearings 25*a* which is disposed on the covers 12 respectively.

The rightmost one of the shafts 22 (which is disposed outside the air-intake pipes) has a portion extending outside from the cover 12, and carries a gear 26.

A connecting pipe 27 (FIG. 1) is disposed at a downstream portion of the intake-air cutoff valves 10*a*, 10*b* and 10*c* (engine side) in parallel with the intake-air-cutoff-valve train. The connecting pipe 27 connects each of the intake-air pipes 4*d*, 4*e* and 4*f* as shown in FIGS. 1 through 6.

The connecting pipe 27 has an exhaust gas inlet 28 formed on its wall as shown in FIG. 4 and connects through the exhaust gas inlet 28 and an exhaust-gas-cutoff valve 29 to an exhaust gas circulating pipe 30 which branches off the exhaust manifold 7*b* (see FIG. 1). The exhaust gases discharged into the exhaust manifold 7*b* (from the cylinders 3*a*, 3*b* and 3*c*) are introduced to the air-intake pipes 4*d*, 4*e* and 4*f* through the circulating pipe 30, the exhaust-gas-cutoff valve 29 and the connecting pipe 27, which compose an exhaust-gas-intake passage 31.

Structure of the exhaust-gas-cutoff valve 29 is described next with reference to FIGS. 3 through 6.

A block member 32 is disposed under the air-intake pipes 4*d*, 4*e* and 4*f*, and a cylindrical space 33 is formed in parallel with the cylindrical space 11 to accommodate the exhaust-gas-cutoff valve 29. A cylindrical bushing 34 which is inserted into the space 33 has a pair of elliptic through-holes 35*a* and 35*b* (FIG. 4 and FIG. 5) in the upper wall portion thereof and a wall portion perpendicular to the upper wall portion. The upper through hole 35*a* connects to the exhaust-gas inlet 28 through a passage 36 formed in the block member 32 and the other through hole 35*b* connects with the exhaust manifold 7*b* through a passage 37 formed in the block member 32 and the exhaust-gas circulating pipe 30.

A generally cylindrical valve member 38 is slidably inserted into the bushing 34. The valve member 38 has round portions at both ends thereof, and a flat-bottomed rectangular groove 39 at the central portion thereof. A shaft 40 extends from the center of the opposite ends of the valve member 38 and is rotatably carried by a pair of bearings 41 which are secured to the block member 32 in such a manner as the intake-air-cutoff valves 10*a*, 10*b* and 10*c* are secured.

The valve member 38 closes the through holes 35*a* and 35*b* when the valve member 38 rotates and the cylindrical surface (except for the groove 39) meets the holes 35*a* and 35*b* and opens them when the valve member 38 rotates and the groove 39 meets the holes 35*a* and 35*b*. That is, the valve member 38 opens or closes the through holes 35*a* and 35*b* at a set interval when it rotates. Accordingly, the exhaust-gas-cutoff valve 29 opens or closes at the set interval.

The left end of the shaft 40 of the exhaust-gas-cutoff valve 29 (illustrated in FIG. 3 and in FIG. 6) connects with a rotary encoder 42 (sensor) which detects the position of the valve member 38.

The right end (opposite end) of the shaft 40 connects with a motor 44 such as a DC motor (valve driving unit) and the intake-air-cutoff valves 10*a*, 10*b* and 10*c* through a geneva movement 43. The geneva movement 43 is disposed in a space 45 formed in the block member 32 as shown in FIG. 3.

The geneva movement 43 has a driving shaft 46 which is disposed coaxially with the shaft 40 of the valve member 38 and is rotatably supported by a wall of the space 45, a driven shaft 47 which is disposed rotatably in the same space 45 in parallel with the driving shaft 46 and a pair of bearings 48 which support both ends of the driving shaft 46 (FIG. 3).

An end of the driving shaft 46 on the side of the exhaust-gas cutoff valve 29 is connected with the shaft 40 of the valve member 38 by a joint 49. There are a driving wheel 50 and a gear 51 of the geneva movement 43 carried on the driving shaft 46.

Figure 8:
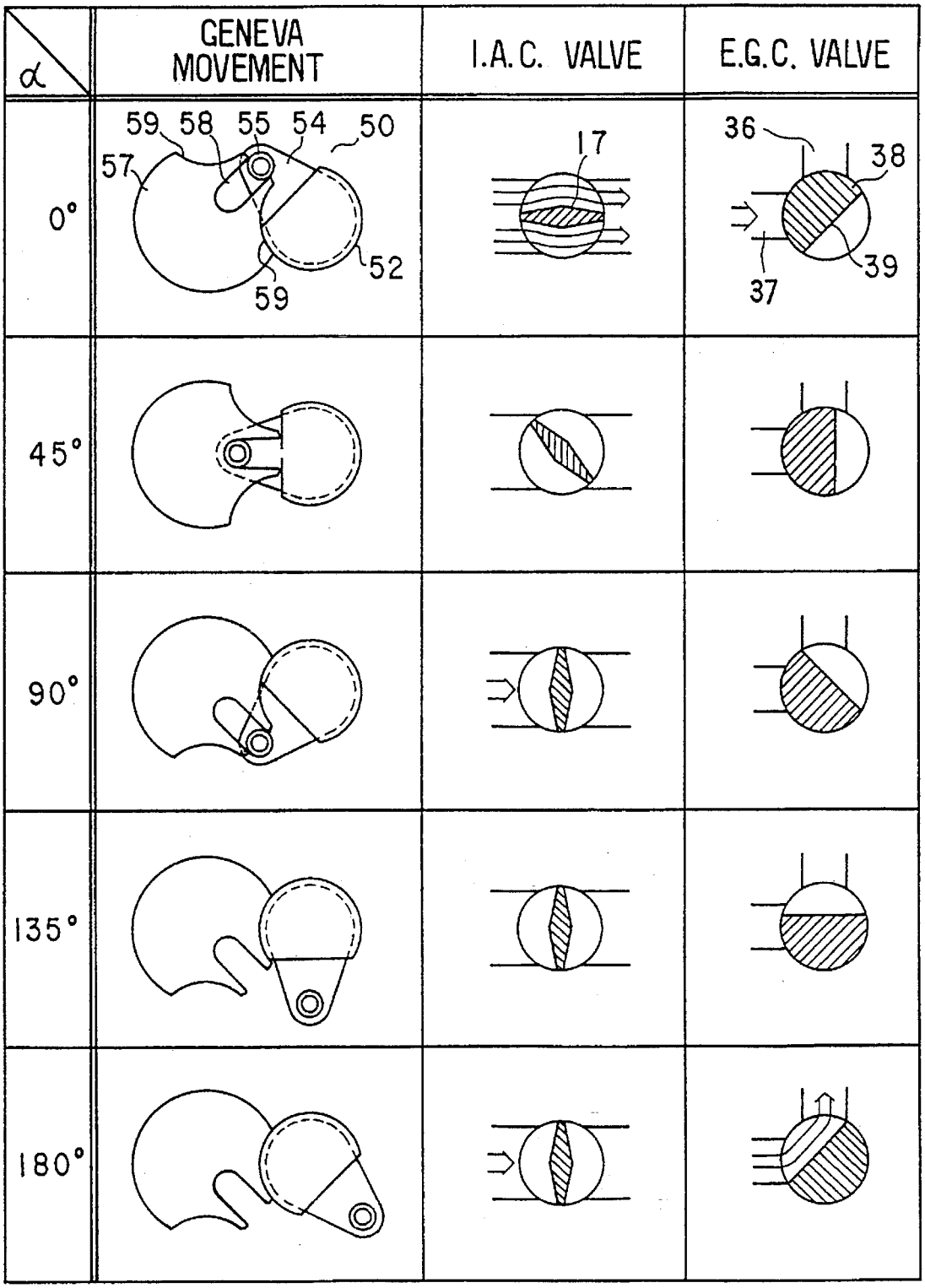
FIG. 8 is a chart illustrating operational sequence of the intake-air-cutoff valve and the exhaust-gas-cutoff valve.

As shown in FIG. 8, the driving wheel 50 of the geneva movement 43 is composed of a semicircular constrained cam 52 which has a flat portion and a crank member 54 which extends radially beyond the flat portion of the cam 52. The crank member 54 has a roller 55 disposed rotatably at the open end thereof in parallel with the cam 52.

Figure 6:
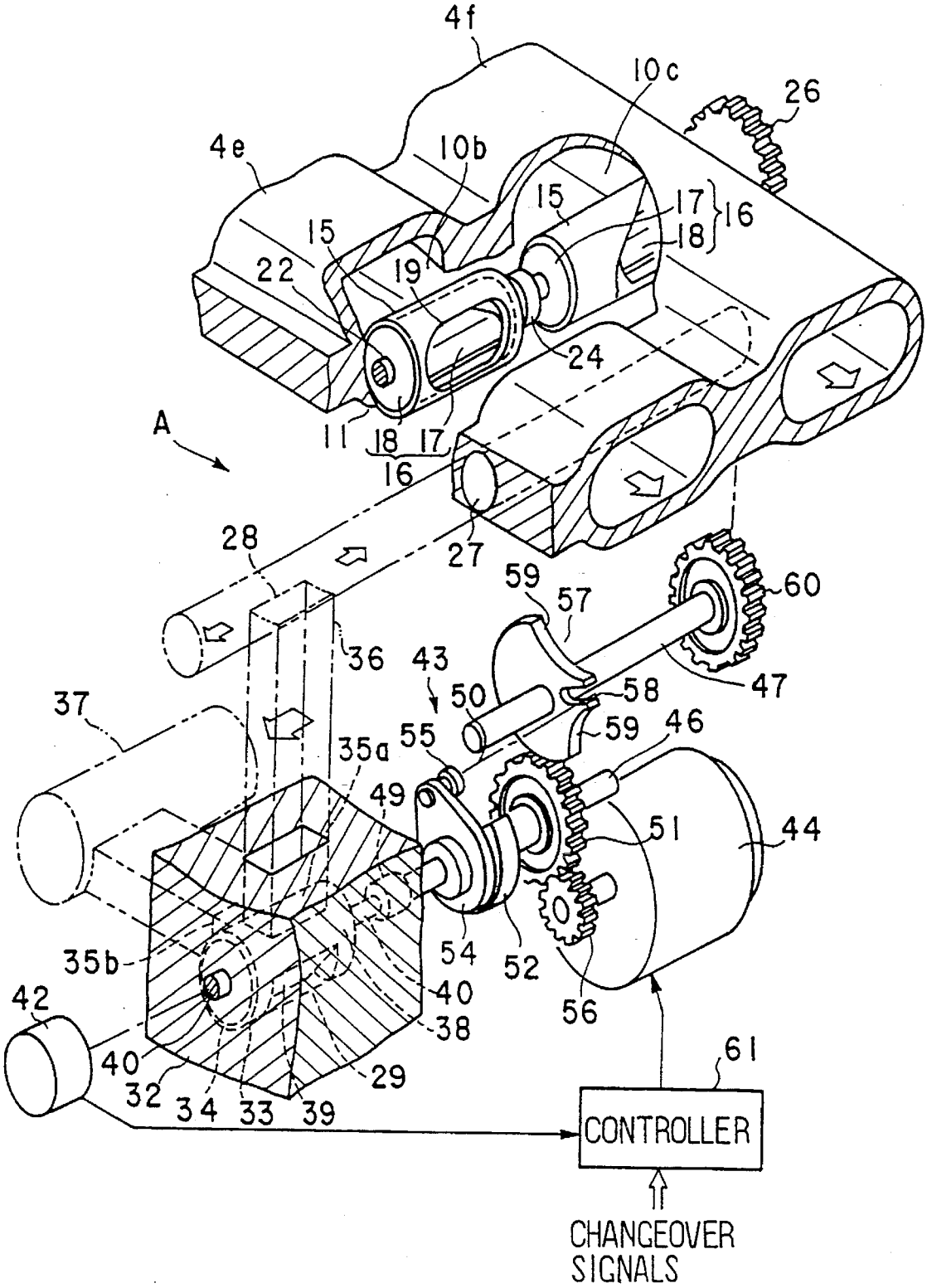
FIG. 6 is an exploded-perspective view illustrating a geneva movement for intermittent control of the intake-air-cutoff valves and the exhaust-gas-cutoff valve for changeover the engine operation between the full-cylinder operation and the partial cylinder operation.

The gear 51 engages a pinion gear 56 which is secured to the output shaft of the motor 44 (FIG. 6). In other words, the driving wheel 50 of the geneva movement 43 and the valve member 38 of the exhaust-gas-cutoff valve 29 are driven by the DC motor 44 via the driving shaft 46.

The driven shaft 47 carries a driven cam 57 thereon on the side of the exhaust-gas-cutoff valve 29 to engage the constrained cam 52 of the driving wheel 50 as shown in FIG. 6.

The semicircular driven cam 57 has a radial groove 58 and arc-shaped cam surfaces 59 formed on the both sides of the groove 58.

The radial groove 58 is formed so that it may readily engage with and disengage from the roller 55. The cam surfaces 59 are formed to engage with the periphery of the constrained cam 52. The above mechanism of engagement of the roller 55 with the groove 58, and the constrained cam 52 with the cam surfaces 59 as illustrated in FIG. 8 converts the rotation of the driving wheel into intermittent motion.

The outside end (right side end in FIG. 3) of the driven shaft 47 extends from a wall of the space 45 and carries a gear 60 in engagement with the gear 26, so that the intermittent motion of the driven shaft 47 is transmitted to the valve members 16 of the intake-air-cutoff valves 10*a*, 10*b* and 10*c* via the gear 60.

Figure 7:
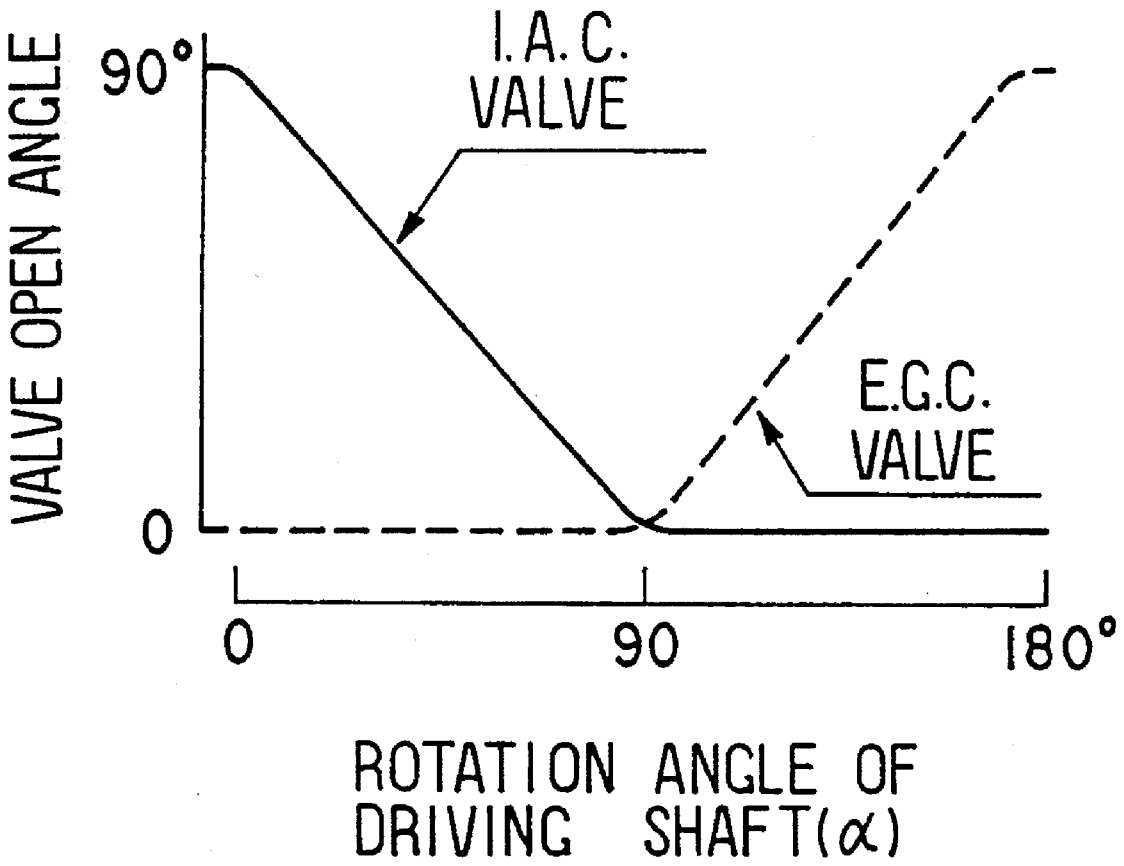
FIG. 7 is a graph showing control timing of the intake-air-cutoff valve and the exhaust-gas-cutoff valve by the geneva movement.

As shown in FIG. 7, the operation timing (intermittent motion) of the geneva movement 43 is set as follows:

the full-cylinder-operation mode (the intake-air-cutoff valve opens and the exhaust-gas-cutoff valve closes) is carried when the rotation angle of the driving shaft 46 becomes 0, the intake-air-cutoff valves 10*a*, 10*b* and 10*c* close as the rotation angle increases from 0° to 90°, and only the exhaust-gas-cutoff valve 29 opens (the position of the intake-air-cutoff valves is unchanged) after the rotation angle exceeds 90° and increases up to 180°.

The operation timing of the geneva movement 43 is explained more concretely hereafter with reference to FIG. 8.

When the driving shaft 46 rotates from angle 0° to 90°, the geneva movement gradually closes the intake-air-valves 10*a*, 10*b* and 10*c* and maintains the exhaust-gas-cutoff valve 29 in the full-close state (synchronous operation). Thereafter (from angle 90° to 180°), the roller 55 disengages from the groove 58 so that the intake-air-cutoff valve 10*a*, 10*b* and 10*c* maintain their full-close state and only the exhaust-gas-cutoff valve 29 opens the passage 37 right after the intake-air-cutoff valves 10*a*, 10*b* and 10*c* have fully closed.

That is, when the full-cylinder-operation mode is changed over to the partial-cylinder-operation mode, the air-intake-pipes 4*d*, 4*e* and 4*f* are first closed before the exhaust-gas circulating pipe 30 is opened.

Of course, the exhaust-gas-circulating pipe is first closed before the air-intake pipes 4*d*, 4*e* and 4*f* are opened when the partial-cylinder operation is changed over to the full-cylinder operation.

A numeral 61 in FIG. 6 indicates a controller (such as a unit including a microcomputer). The controller is connected to the rotary encoder 42 and the DC motor 44.

When a partial-mode-changeover signal which indicate the changeover from the full-cylinder-operation mode to the partial-cylinder-operation mode (under a partial-load engine condition) is received, the controller 61 controls the DC motor 44 to rotate the driving shaft 46 from the angle 0° position (for the full-cylinder operation) to the angle 180° position (partial-cylinder operation). On the other hand, when the controller 61 receives a full-mode-changeover signal (full-load engine condition), it controls the DC motor 44 to rotate the driving shaft 46 from the angle 180° position to the angle 0° position.

Next, the operation of the cylinder control device 'A' is explained.

When a six-cylinder engine operates under the full-cylinder operation mode, the intake-air-cutoff valves 10*a*, 10*b* and 10*c* are fully opened and the exhaust-gas-cutoff valve 29 is fully closed as in FIG. 8 (0°).

In other words, the suspended cylinders 3*a*, 3*b* and 3*c* are connected with the air-intake manifold 5 and disconnected from the exhaust-gas-intake passage 31. Thus, all the cylinders 2*a*, 2*b*, 2*c*, 3*a*, 3*b* and 3*c* introduce the air from the air-intake manifold 5 therein to burn fuel and discharge exhaust gases during the engine combustion cycle, thereby generating a vehicle driving power. The exhaust gases produced by the cylinders 2*a* through 3*c* are discharged through the exhaust manifold 7*a* and 7*b*, the catalytic converter 8 and the exhaust pipe 9 to the atmosphere. Since the passage 31 is closed by the exhaust-gas-cutoff valve during this operation mode, the exhaust gases do not get into the air-intake pipes 4*d*, 4*e* and 4*f*.

When the car is driven at a light load or with a small opening angle of the throttle valve, the controller 61 receives a partial-mode-changeover signal. The controller 61 controls the DC motor 44 to rotate, for example, clockwise. Then, the driving torque is transmitted through the driving wheel 50 of the geneva movement 43, the driven cam 57, the driven shaft 47 and the gears 60 and 26 to all the intake-air-cutoff valves 10*a*, 10*b* and 10*c* to close as shown in FIG. 8. The driving torque of the DC motor 44 is also transmitted through the driving shaft 46 and shaft 40 to the exhaust-gas-cutoff valve 29 to open.

The operation of the geneva movement 43 is further explained with reference to FIG. 8 next.

When the rotation angle of the driving shaft 46 is 0°, only the periphery of the disk-shaped constrained cam 52 (of driving wheel 50) engages the arc-shaped cam surface 59 of the driven shaft 57 to regulate the motion of the driven cam 57, thereby maintaining the full-open position of the intake-air-cutoff valves 10*a*, 10*b* and 10*c*.

The driving shaft 46 is driven by the DC motor 44 to rotate from this angle 0° position according to the mode changeover control. The constrained cam 52 and the driven cam 57 are held in engagement with the roller 55 sliding within the groove 58 until the driving shaft 46 rotates to angle 90°. In other words, the constrained cam 52 and the driven cam 57 rotate as a unit until the driving shaft 46 rotates to the angle 90°. The intake-air-cutoff valves 10*a*, 10*b* and 10*c* changes gradually from the full-open state to the full-close state as the rotation angle increases. The exhaust-gas-cutoff valve 29 maintains its close state until the driving shaft rotates right after 90° because of the specific valve structure.

When the rotation angle becomes 90°, the roller 55 comes to the open end of the groove 58 again and leaves it, and consequently the torque transmission to the driven cam 57 is interrupted. Then, the arc-shaped cam surface of the driven cam 57 slide on the periphery of the constrained cam 52 so that it is held at the same position as the angle 90° until up to the angle 180°. Thus, the intake-air-cutoff valve 10*a*, 10*b* and 10*c* keep closing the air-intake pipes 4*d*, 4*e* and 4*f*. That is, the intake-air-cutoff valves 10*a*, 10*b* and 10*c* maintain the close state after the angle 90°.

On the other hand, the driving shaft 46 is driven further by the DC motor 44 to rotate the valve member 38 of the exhaust-gas-cutoff valve 29 from the rotation angle 90° up to the angle 180° so that the valve member 38 gradually connects the passages 36 and 37 as shown in FIG. 8.

When the driving shaft 46 has rotated to the angle 180°, the rotary encoder 42 detects the position of the driving shaft 46 and sends a signal to the controller 61, which deenergizes the DC motor to hold the exhaust-gas-cutoff valve in the full-open state.

Figure 2:
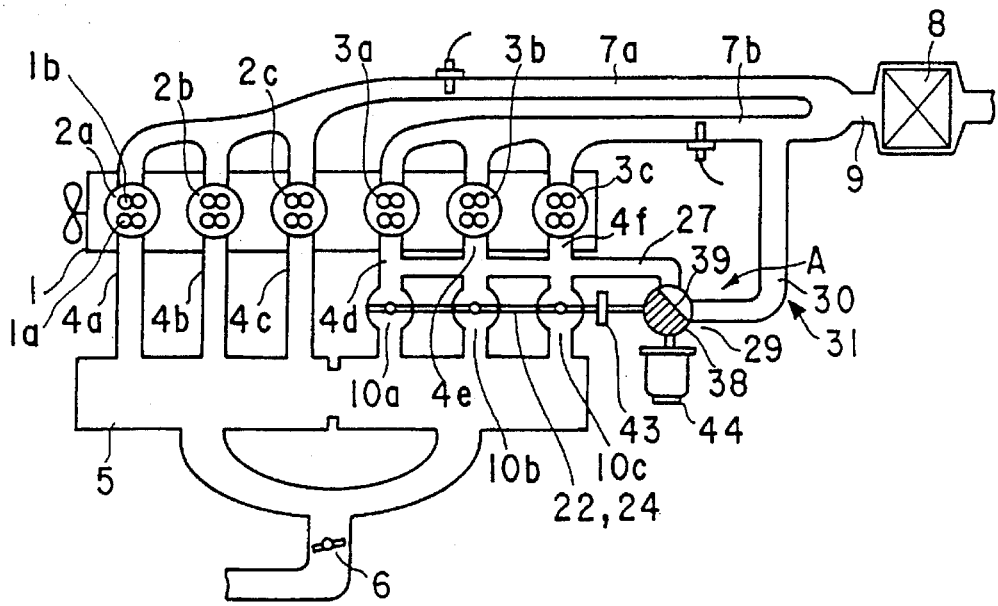
FIG. 2 is a schematic plan view illustrating the engine in a partial-cylinder (three-cylinder) operation with the device for controlling number of operating cylinders according to the first embodiment.

Consequently, the circulating passage which includes the cylinders 3*a*, 3*b* and 3*c*, the exhaust manifold 7*b*, the exhaust gas circulating pipe 30, the exhaust-gas-cutoff valve 29, the connecting pipe 27 and the air-intake pipes 4*d*, 4*e* and 4*f* is formed as shown in FIGS. 2 and 5.

As a result, fresh air is cut off and exhaust gases discharged from the cylinders 3*a*, 3*b* and 3*c* into the common exhaust manifold 7*b* are sucked by the same cylinders through the exhaust-gas circulating pipe 30, the connecting pipe 27 and the air-intake pipes 4*d*, 4*e* and 4*f*, and only the cylinders 2*a*, 2*b* and 2*c* operate.

Since the exhaust gases circulate in the cylinders 3*a*, 3*b*, and 3*c*, pumping power loss of the suspended cylinders 3*a*, 3*b* and 3*c* as well as the operating cylinders 2*a*, 2*b* and 2*c* (due to reduction in vacuum pressure in the intake manifold 5) is small, and significant improvement of the fuel consumption is attained.

When the engine load increases from a light load, to a medium or full load, a return-mode signal is sent to the controller 61 and the partial-cylinder operation is changed over to the full-cylinder operation as follows.

The controller 61 drives the DC motor to rotate in the opposite direction, thereby returning the driving shaft 46 to the rotation angle 0° from the rotation angle 180°. Consequently, the geneva movement 43 returns toward the angle 0° position tracing the same operations shown in FIG. 8, however, in the opposite direction. Thus, the exhaust-gas-cutoff valve 29 changes over to the close position from the open position as the rotation angle changes from 180° to 90° and the intake-air-cutoff valve 10*a*, 10*b* and 10*c* change over to the full open position from the full close position as the rotation angle changes from 90° to 0°.

Thus, the suspended cylinders 3*a*, 3*b* and 3*c* return to operation, resulting in the full-cylinder engine operation.

In summary, when the full-cylinder engine operation is changed over to the partial-cylinder operation, the exhaust-gas-cutoff valve 29 connects the exhaust gas circulating pipe 30 and the connecting pipes 27 right after the intake-air-cutoff valve 10*a*, 10*b* and 10*c* have closed the air-intake pipes 4*d*, 4*e* and 4*f*, while when the partial engine operation is changed over to the full-cylinder engine operation, the intake-air-cutoff valves 10*a*, 10*b* and 10*c* open the air-intake pipes 4*d*, 4*e* and 4*f* right after the exhaust gas-cutoff valve 29 has cut off the connection between the exhaust gas circulating pipe 30 and the connecting pipe 27.

It is noted that the set timing of the geneva movement 43 prevents exhaust gases from entering the air-intake passage during the changeover of the operation mode, engine troubles caused by exhaust gases are eliminated. The set timing is also changeable and may be synchronized with the operation timing of the intake valve or the exhaust valve.

It is noted that no time is necessary for the geneva movement to change over the engine operation mode, while an electronic control device needs time to process signals before the changeover of the engine operation mode.

Since the driving force of the single DC motor 44 is divided to drive the intake-air-cutoff valves and the exhaust-gas-cutoff valve 29, only the starting time period of the DC motor 44 is necessary (the motor starting time is the main factor of the response time of the device).

As a result, a highly responsive cylinder control device which is simple, inexpensive and free from torque-shocks or stagnation of engine operation is provided.

Figure 9:
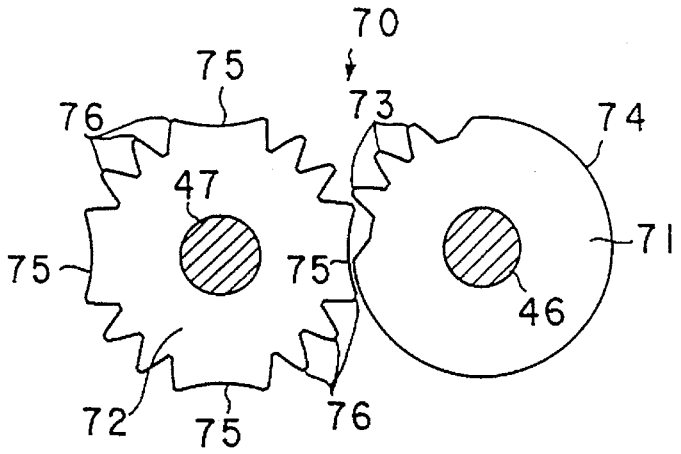
FIG. 9 is a plan view of a main part of an intermittent gear train according to a second embodiment of the present invention.

FIG. 9 shows a second embodiment of the present invention. In the second embodiment, an intermittent gear mechanism 70 is employed in place of the geneva movement 43 of the first embodiment. The intermittent gear mechanism is composed of a driving gear 71 instead of the driving wheel of the first embodiment and driven gear 72 instead of the driven cam of the first embodiment.

The driving gear 71 has a few teeth 73 on a portion of about a quarter of the periphery thereof and a circular portion 74 (pitch circle). The driven gear 72 has arc-shaped cam surfaces 75 formed on four peripheral portions coaxially with its shaft 47 at an equal interval (90°) and teeth 76 formed between the cam surfaces. The teeth 73 of the driving gear 71 and the teeth 76 of the driven gear 72 are put in engagement so that driven gear rotates the driven shaft 47 in the same manner as in the first embodiment, and the outer periphery of the driving gear 71 is put in slidable abutment with the arc-shaped cam surface 75 so that the driven gear is held at rest as in the first embodiment.

When the driving gear 71 rotates between the rotation angle 0° to the rotation angle 180°, the intake-air-cutoff valves and the exhaust-gas-cutoff valve operate in the same manner as those of the first embodiment.

The driving gear 71 can be arranged to rotate to 360° in a manner obvious to persons skilled in this field instead of the reciprocating between 0° to 180° as in the previous embodiments.

Figure 10:
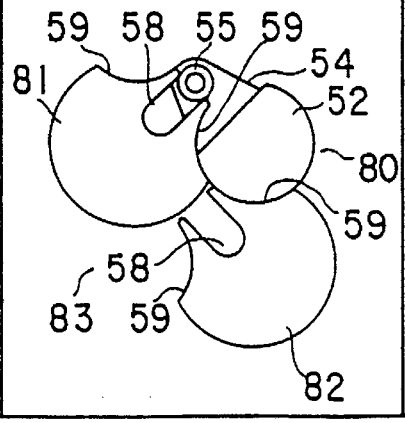
FIG. 10 is a chart illustrating a geneva movement according to a third embodiment of the present invention with the intake-air-cutoff valve and the exhaust-gas-cutoff valve in an operational timing.
Figure 10:
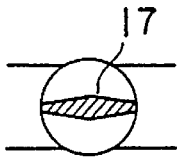
Figure 10:
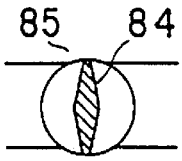

A third embodiment is described next with reference to FIG. 10.

A geneva movement 83 of this embodiment has a driving wheel 80 and a couple of driven cams 81 and 82. The driving wheel 80 has the same structure as the driving wheel 50 of the first embodiment, and the driven cams 81 and 82 are also the same as the driven cam 57 of the first embodiment in structure.

A driving shaft (not shown) connecting the exhaust-gas-cutoff valve 29 and the DC motor 44 is divided into two: a valve-side shaft which connects with the exhaust-gas-cutoff valve and a motor-side shaft. The motor-side shaft is disposed horizontally in parallel with a driven shaft and disposed vertically in parallel with the valve-side shaft. The driving wheel 80 is carried on the motor-side shaft and the driven cam 81 is carried on the driven shaft which connects with the intake-air-cutoff valves as described in the first embodiment. The other driven cam 82 is carried on the valve-side shaft. The driving wheel 80 rotates from angle 0° to angle 180°. As the driving wheel 80 rotates from 0° to 90°, the roller 55 (the same as the first embodiment) engages with the groove 58 of the driven cam 81 so that the intake-air-cutoff valves 10*a*, 10*b* and 10*c* operate from the full-open state to the full-close state. As the driving wheel 80 further rotates from the angle 90° to the angle 180°, the roller 55 engages the groove 58 of the other driven cam 82 so that a plate valve member 84 and a valve body 85 (shown in FIG. 10) of the exhaust-gas-cutoff valve 29 operates from the full-close state to the full-open state.

When the engine operation is changed over from the full-cylinder-operation mode to the partial-cylinder-operation mode, the exhaust-gas-cutoff valve 29 is not opened until the intake-air-cutoff valve has been closed, and when the engine is changed over from the partial-cylinder operation to the full-cylinder operation, the air-intake-cut off valves 10*a*, 10*b* and 10*c* are not opened until the exhaust-gas-cutoff valve has been closed, as in the first embodiment.

Other mechanisms instead of the above described geneva movement may be utilized to intermittently control the intake-air-cutoff valves and the exhaust-gas-cutoff valve as in the first embodiment.

Although the embodiments of the present invention are described with a six-cylinder engine, the invention is also applicable to engines having different number of cylinders of other type (diesel engine, rotary engine or else).

In the foregoing discussion of the present invention, the invention has been described with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than a restrictive, sense.

What is claimed is:

1. A device for controlling number of operating cylinders of an internal combustion engine having full-time operating cylinders, controlled cylinders, an air intake manifold and exhaust gas manifolds connected respectively to said full-time cylinders and said controlled cylinders, said device comprising:

a housing;

a plurality of passage members disposed in said housing for connecting each of said controlled cylinders with said air intake manifold;

a plurality of intake-air-cutoff valves disposed in said housing for opening and closing said passages;

an exhaust-gas-circulation pipe connecting said exhaust pipe connected to said controlled cylinders and a downstream portion of each of said intake-air-cutoff valves;

an exhaust-gas-cutoff valve disposed in said housing for opening and closing said exhaust-gas-circulation pipe;

an electric motor disposed in said housing for supplying a force to drive said intake-air-cutoff valves and said exhaust-gas-cutoff valve; and a link movement, disposed in said housing between said motor and said both valves, for transmitting said driving force intermittently so that said both valves operate at a set interval.

2. A device according to claim 1, wherein said link movement comprises a geneva movement.

3. A device according to claim 2 wherein said geneva movement comprises a driving wheel connected with said DC motor and a driven cam connected with said intake-air-cutoff valve, said driving wheel having a crank member, a roller disposed on said crank member and a constrained cam, said driven cam having a groove to be in engagement with said roller and a cam surface to be in abutment with said constrained cam.

4. A device according to claim 2, wherein said geneva movement comprises a driving wheel connected with said DC motor, a first driven cam connected with said intake-air-cutoff valve and a second driven cam connected with said exhaust-gas-cutoff valve, said driving wheel having a crank member, a roller disposed on said crank member and a constrained cam, said first and second driven cam having a groove engagemeable with said roller and a cam surface abutable with said constrained cam.

5. A device for controlling number of operating cylinders of an internal combustion engine having a full-time operating cylinder, a controlled cylinder, an air intake manifold and an exhaust gas manifold, said device comprising:

an intake-air-cutoff valve disposed in a passage between said air intake manifold and said controlled cylinder for opening and closing said passage;

an exhaust-gas-circulation pipe connecting said exhaust pipe at a downstream portion of said controlled cylinder and a downstream portion of said intake-air-cutoff valve;

an exhaust-gas-cutoff valve disposed in a portion of said exhaust-gas-circulation pipe for opening and closing said portion;

a valve driving unit for supplying a force driving said intake-air-cutoff valve and said exhaust-gas-cutoff valve; and a link movement, disposed between said valve driving unit and said both valves, for transmitting said driving force so that said both valves operate at a set interval, wherein said link movement transmits said driving force so that said exhaust-gas-cutoff valve does not open as long as said intake-air-cutoff valve keeps opening.

6. A device according to claim 1, wherein said valve driving unit comprises a DC motor and a control unit for controlling said DC motor according to engine operating conditions.

7. A device according to claim 5, wherein said link movement comprises a mechanism for intermittently driving said intake-air-cutoff valve and said exhaust-gas-cutoff valve.

8. A device according to claim 7, wherein said mechanism comprises a geneva movement.

9. A device according to claim 8, wherein said geneva movement comprises a driving gear having gear teeth on a part of the periphery thereof connected with said DC motor and a driven gear to be in engagement with said driving gear which is connected with said intake-air-cutoff valve.

10. A device according to claim 8, wherein said geneva movement comprises a driving wheel connected with said DC motor a first driven cam connected with said intake-air-cutoff valve and a second driven cam connected with said exhaust-gas-cutoff valve, said driving wheel having a crank member, a roller disposed on said crank member and a constrained cam, said first and second driven cam having a groove to be in engagement with said roller and a cam surface to be in abutment with said constrained cam.

11. A device according to claim 8, wherein said geneva movement comprises a driving wheel connected with said DC motor and a driven cam connected with said intake-air-cutoff valve, said driving wheel having a crank member, a roller disposed on said crank member and a constrained cam, said driven cam having a groove to be in engagement in said roller and a cam surface to be in abutment with said constrained cam.

12. A device according to claim 11 further comprising a block member for securing said DC motor and said geneva movement.

13. A device according to claim 12, wherein said block member comprises integral housings for said intake-air-cutoff valve and said exhaust-gas-cutoff valve.

14. A device according to claim 12, wherein said block member comprises an integral housing for DC motor and said mechanism for intermittently driving said intake-air-cutoff valve.

15. A device according to claim 14, wherein said block member comprises integral housings for said intake-air-cutoff valve and said exhaust-gas-cutoff valve.

* * * * *